United States Patent [19]

Tantardini

[11] Patent Number: 4,768,935

[45] Date of Patent: Sep. 6, 1988

[54] VOLUMETRIC BLADE PUMP FOR FLUID-HYDRAULIC ACTUATION

[75] Inventor: Paolo Tantardini, Milan, Italy

[73] Assignee: Atos Oleodinamica S.p.A., Milan, Italy

[21] Appl. No.: 52,215

[22] Filed: May 19, 1987

Related U.S. Application Data

[63] Continuation of Ser. No. 785,388, Oct. 8, 1985, abandoned.

[51] Int. Cl.[4] ..... F04C 2/344; F04C 15/04

[52] U.S. Cl. ..... 418/30; 418/132

[58] Field of Search ..... 418/30, 131–133

[56] References Cited

U.S. PATENT DOCUMENTS

| | | | |
|---|---|---|---|
| 465,907 | 12/1891 | Whipple | 418/131 |
| 1,996,875 | 4/1935 | McCann | 418/131 |
| 2,189,969 | 2/1940 | Taglio | 418/131 |
| 3,187,993 | 6/1965 | Rhodes | 418/131 |
| 3,270,680 | 9/1966 | Rich | 418/132 |
| 3,371,615 | 3/1968 | Pettyjohn | 418/132 |
| 3,376,824 | 4/1968 | Turolla | 418/133 |
| 3,415,058 | 12/1968 | Underwood | 418/30 |
| 3,748,063 | 7/1973 | Putnam | 418/132 |
| 3,891,360 | 6/1975 | Dworak | 418/132 |
| 3,909,165 | 9/1975 | Laumont | 418/132 |
| 4,311,444 | 1/1982 | Shunate | 418/131 |
| 4,337,018 | 6/1982 | Singer | 418/132 |
| 4,416,598 | 11/1983 | Merz | 418/133 |

FOREIGN PATENT DOCUMENTS

| | | | |
|---|---|---|---|
| 2744730 | 4/1979 | Fed. Rep. of Germany | 418/132 |

*Primary Examiner*—John J. Vrablik

*Attorney, Agent, or Firm*—Diller, Ramik & Wight

[57] ABSTRACT

In a volumetric blade pump for fluid-hydraulic actuation, provided with a blade-bearing rotor and with a stator of annular shape mounted around the rotor, for the closure of the stator, on at least one side of the stator, a couple of plates are provided, of which one, stationary, rigidly constrained at the outside of the stator side, and the other, movable, positioned inside the stator between the stationary plate and the rotor; on both faces of the movable plate the delivery pressure of the pump is active.

39 Claims, 2 Drawing Sheets

VOLUMETRIC BLADE PUMP FOR FLUID-HYDRAULIC ACTUATION

This application is a continuation of application Ser. No. 785,388, filed Oct. 8, 1985, and now abandoned.

The present invention relates to a volumetric blade pump for fluid-hydraulic actuation, comprising a blade-bearing rotor and a stator of annular shape mounted around the rotor, and closed at its sides, so as to form a generally closed box, within which the rotor is housed.

In the known structures, for the closure of the stator, on at least one side a plate leaning against it along a circular annulus is provided. The plate is inwards facing a correspondent side of the rotor, with which it forms small play gaps due to lubrication reasons.

On its inner face in correspondence of the delivery zone the plate is subjected to the delivery pressure generated inside the variable-volume chambers defined by the blades. To the purpose of counterbalancing such a pressure the same is transferred, through hydraulic connections, on to the outer face of the plate, causing it to act on a thrust section larger than on the inner face. In that way, by the pressure acting on the two sections being the same, on the outer face of the plate a force shall be generated greater than that acting on the inner face of the same plate, so as to keep the plate forced against the stator.

Under the action exerted by its greater force, the plate is deformed towards the rotor in its central portion (in that the plate is leaning on the stator along a circular annulus only) and to an always increasing extent with increasing values of the delivery pressure, so as to reduce the play gap existing between the plate and the rotor, thus avoiding an undesirable increase of fluid leaks along the sides of this latter with increasing pressures.

On the other side of the rotor, a plate may be provided supported and operating as the one hereinabove described, or a plate rigidly fastened on to the stator may be provided, the movable plate compensating for the play gaps, as known, by taking advantages of small axial movements possible for the rotor.

This type of closure of the sides of the stator leads however to some drawbacks.

Such drawbacks arise from the fact that the force of greater value, acting on the outer face of the plate, must deform it due to the above mentioned reasons of hydraulic compensation. The deformation level of a point of the plate is clearly inversely proportional to the distance of such a point from the leaning zone of the plate to the stator.

This causes a complete alteration of the play gaps between the plate and the rotor, so as to cause abnormal leaks along the sides of this latter, which decrease the efficiency of the pump and may increase its noisiness.

Moreover the said stresses can cause with time wears and permanent deformations of the plate which make the situation still worse.

Purpose of the present invention is to propose a blade pump of the type described above, with such a closure of the stator as to overcome the said drawbacks which are observed in the known structures.

Such purpose is achieved by providing a volumetric blade pump for fluid-hydraulic actuation, comprising a body enclosing a blade-bearing rotor and a ring-shaped stator mounted around the rotor, and closed at both its sides so as to form an inner housing for the rotor, it being provided, for the closure of the stator, on at least one side of said stator, a first plate enclosed within the stator, facing a corresponding side of the rotor with one of its faces, and closed on its opposite face by a second plate rigidly fastened at the outside to the side of the stator, in the pump hydraulic passages being moreover provided to bring fluid under pressure from the delivery on to said opposite face of said first plate, at least a sealing element being moreover provided, which defines on said opposite face of said first plate a thrust section of said first plate against the side of the rotor due to the effect of the delivery pressure reported through said hydraulic passages.

To the purpose of understanding the characteristics and the advantages of the present invention, hereinunder a disclosure is reported of an exemplifying not limitative embodiment thereof, as illustrated in the hereto attached drawing tables, wherein.

Figure 1:
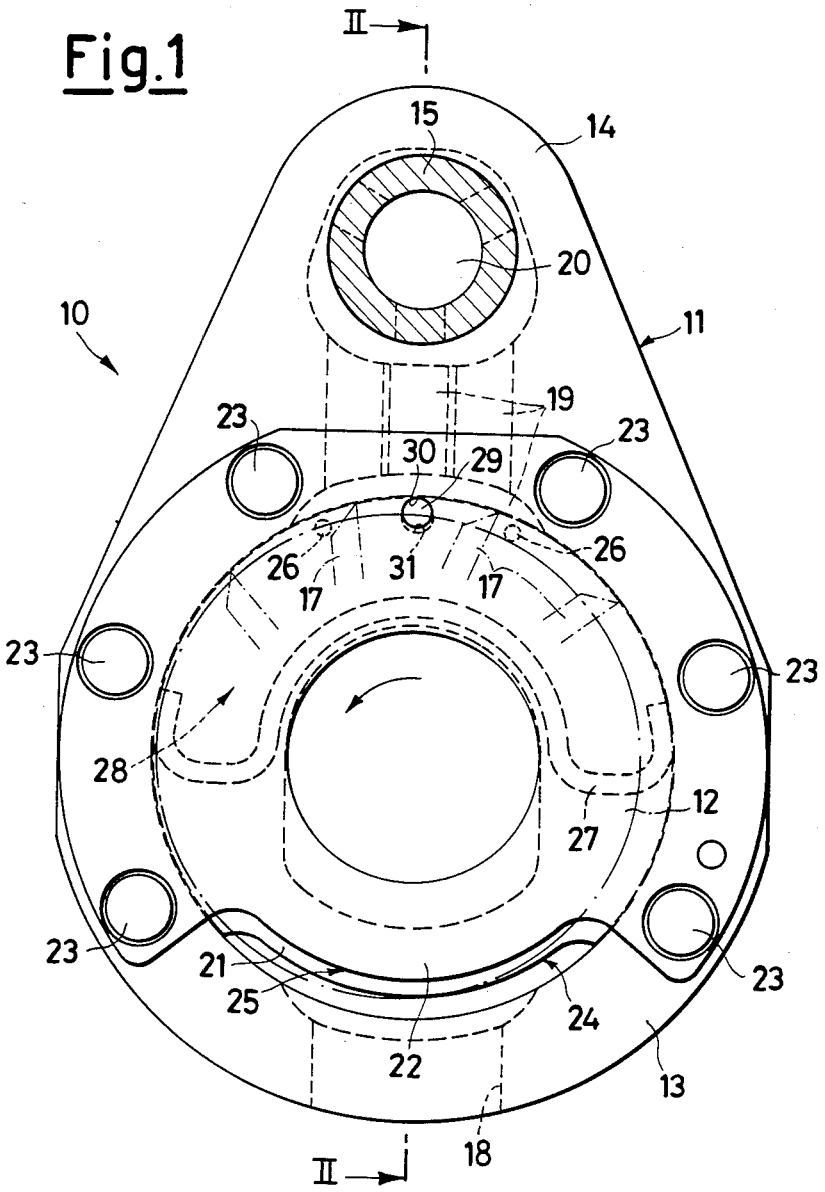
FIG. 1 is a front view of a pump according to the invention.

The volumetric blade pump illustrated, generally indicated with 10, is of the type with variable displacement.

It comprises a movable stator 11 within which a blade-bearing rotor 12 is enclosed.

The stator 11 with the rotor 12 are housed within a body not shown.

The stator 11 is constituted by a portion 13 of annular shape and by a portion 14, extending from the portion 13, which is hinged on a pivot 15 fastened on to the body of the pump 10.

The rotor 12 is constrained on to a shaft 16, which rotatably drives the rotor 12 under the action of a motor (not shown). The rotor 12 bears a set of annular blade 17 which, during the rotation of the rotor 12, slide with their end points against the inner annular profile of the portion 13 and define chambers within which the fluid is delivered from the intake zone to the delivery zone.

In a zone of the stator 11 an intake passage 18 is provided, and in an opposite zone delivery passages 19 are provided, which are in constant communication with an axial duct 20 inside the pivot 15, which brings the fluid under pressure towards a not shown outer port of the pump 10.

To the purpose of varying the displacement of the pump 10, one may operate, according to a known system, by means of a couple of pistons opposite to each other,not shown, actuated by a suitable hydraulic system, which cause the stator 11 to oscillate around the pivot 15 in either direction, so as to move the stator 11 in an eccentric fashion relatively to the rotor 12, varying the expansion and contraction degree of the chambers defined by the blades 17.

The stator 11 is closed at its both sides as follows.

For each side of the stator 11 a first plate 21 and a second plate or counterplate 22 is used, both being provided with a bore (unnumbered) so as to be slid on to the shaft 16.

Each plate 21 has an outer diameter not greater than the inner diameter of the ring-shaped portion 13 of the stator 11, and is leaning on a corresponding side of the rotor 12 inside the said portion of the ring-shaped portion 13.

Figure 2:
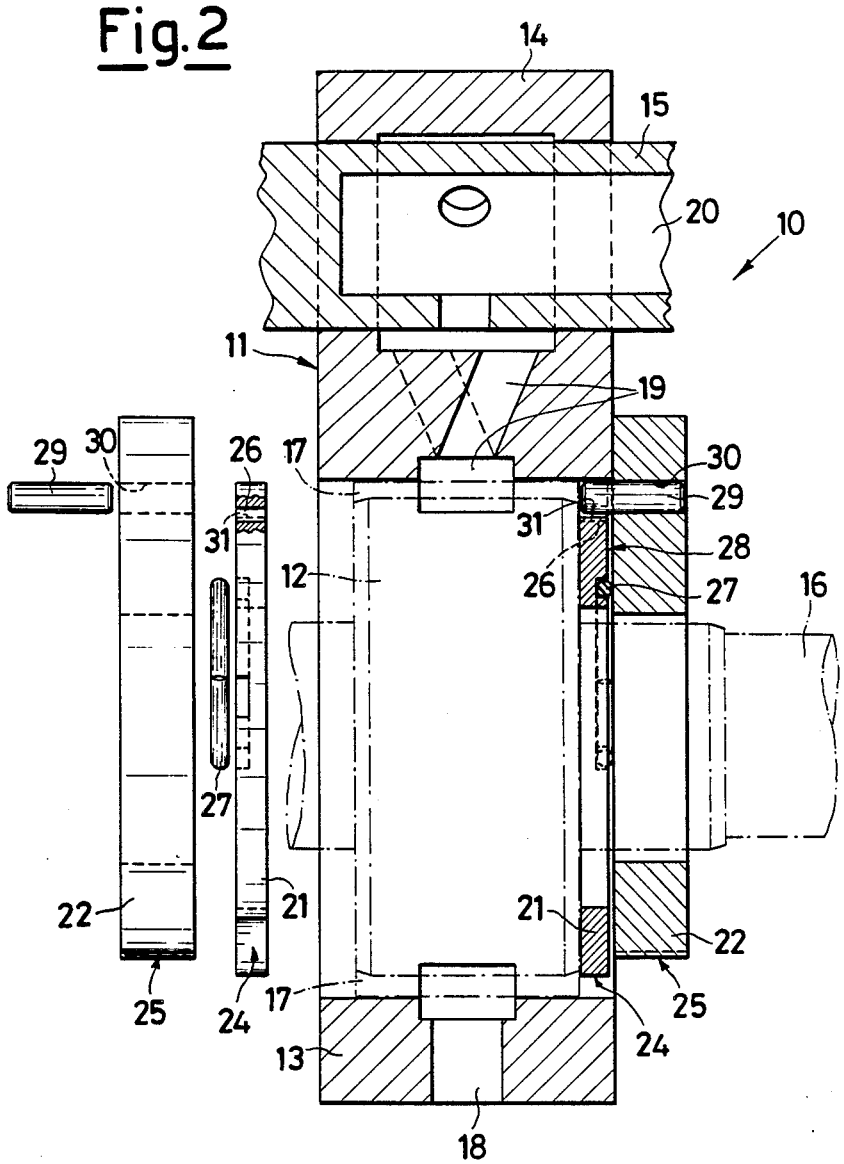
FIG. 2 is a section according to the path II—II of the pump of FIG. 1, with some elements shown in "exploded" view.

The counterplate 22 has on the contrary an outer diameter greater than the inner diameter of the portion 13 and is fastened thereto, on the outside, by means of a set of screws 23, so that the plate 21 remains interposed and retained between the corresponding side of the rotor 12 and the same counterplate,as it clearly illustrated in FIG. 2. A small play gap is left between the plate 21 and the two said elements enclosing it, due to lubrication reasons.

In each plate 21 a generally partially peripherally extending, radially outwardly opening nick, notch or cut-out 24 is provided, and correspondently in each counterplate 22 a generally partially peripherally extending, radially outwardly opening nick, notch or cut-out 25 is provided, which create further fluid intake passages, in addition to the passage 18, in the intake zone of the pump 10.

In the delivery zone of the pump 10, on the contrary, in correspondence of the chambers defined by the blades 17, in each plate 21 two through-bores 26 are provided for the purpose of causing fluid under pressure to reach the face of the plate 21 opposite to the face facing the side of the rotor 12. On said opposite face a sealing gasket 27 is fastened, which bounds a section 28 onto which the fluid applies its pressure, preventing said fluid from flowing furthermore, thus reaching other zones of the pump 10.

For the assembling of the plate 21/counterplate 22 couple, a stud 29 is provided, intended to be engaged inside two corresponding seats 30 and 31 of the two said elements, so as to position them correctly relatively to the stator 11/rotor 12 unit (see exploded parts of FIG. 2).

During the operating of the pump 10, each plate 21 shall hence be subject to fluid under pressure against the corresponding side of the rotor 12, along the thrust section 28 bounded by the gasket 27. In order to that to occur, it is obviously necessary that such thrust section 28 be larger than the opposite section of the plate 21 on to which the fluid delivery pressure acts directly.

By means of such a closure of the stator 11, the drawbacks of the known structures, as shown in the introduction, are overcome.

The plate 21 effects indeed a compensation for the play gaps with varying pressures, by simply moving along the axis of the shaft 16, always remaining parallel to the side of the rotor 12, and urging on it throughout its surface. Hence, no such deformations of the plate, as experienced in the known art, occur.

Moreover, the forces being considered must not be necessarily high, in that they must not be suitable to deform the plate. Hence, the loads acting on the stationary counterplate 22, under the effect of the delivery pressure, are relatively reduced, so as not to cause with time breakdowns or wears due to fatigue.

This all leads to an optimum operation over time of the pump 10 at all values of delivery pressure.

The present exemplifying embodiment is not limitative of possible modifications and/or additions.

The bores 26 and the plate 21, through which the delivery pressure is transferred on to the thrust section 28, may be replaced by one or more notches provided in the plate 21 in correspondence of the delivery zone, analogous to the generally partially peripherally extending, radially outwardly opening nick, notch or cut-out 24 of the opposite intake zone.

The gasket 27 may be fastened on to the counterplate 22 instead of on to the plate 21. It may moreover have a closed configuration instead of an open one.

In the embodiment as disclosed and illustrated a single thrust section 28 is suggested for the plate 21. However, more thrust sections may be provided, defined by respective gaskets, having suitable positioning and distribution on the plate, to the purpose of optimizing the axial thrusts of the delivery pressure, and of minimizing friction or hysteresis effects consequent to the shift of the plate.

In the plate 21 grooves may be provided on its face facing the rotor 12 to the purpose of decompressing the chambers between the blades during the step of transfer or of compression of the fluid between the zone of intake and the delivery zone.

The present exemplifying embodiment provided a closure of the stator 11 by means of a movable plate 21 and a stationary counterplate 22 on both sides of the same stator (FIG. 2). One may also think to close the stator at one side only by means of a movable plate and a stationary counterplate, whilst at the other side a single stationary plate rigidly constrained to the stator is used. Obviously, for the compensation for the play gaps it shall be necessary that to the rotor small axial rotors are allowed, as it happens in the known pump structures, wherein the stator is closed at one side by a plate leaning to it, and at the other side by a plate rigidly constrained to it.

The blade pump 10 to which reference is made in the exemplifying embodiment is of the type with movable stator. The closure by movable plate and stationary counterplate can clearly be applied also to blade pumps with stationary stator.

The closure by movable plate and stationary counterplate results however particularly advantageous if applied to such a pump as that herein disclosed and illustrated, wherein the stator is hinged on to a pivot fastened on to the pump body. The characteristics of optimum efficiency and of low noisiness and wear of such pumps are indeed increased.

I claim:

1. A blade pump comprising a stator having a circular opening, a rotor within said stator circular opening, said rotor carrying a plurality of movable blades for increasing fluid pressure upon rotation of said rotor relative to said stator, said rotor having axially opposite end faces, inlet and outlet means for respectively delivering fluid to and removing pressurized fluid from said rotor, a first plate within said stator circular opening, said first plate having axially opposite end faces, a first of said first plate end faces opposing a first of said rotor end faces and defining therewith at said outlet means a fluid pressure zone subject to the thrust of fluid pressure generated thereat, passage means for directing fluid pressure to a fluid counterbalancing zone defined by a sealing means at said first plate second face generally axially opposing said fluid pressure zone, a second plate adjacent said first plate second end face, means for rigidly securing said second plate to said stator, and means between said first and second plates for preventing rotation of said first plate within said stator circular opening under the rotational forces created by rotation of said rotor relative to said stator.

2. The blade pump as defined in claim 1 wherein said rotation preventing means is a connection between said first and second plates.

3. The blade pump as defined in claim 1 wherein said rotation preventing means is an axial interconnection between said first and second plates.

4. The blade pump as defined in claim 1 wherein said rotation preventing means includes pin and opening interconnection means between said first and second plates.

5. The blade pump as defined in claim 1 wherein said rotation preventing means includes pin and opening interconnection means between said first and second plates, and said pin and opening interconnection means includes a pin projecting from said first plate received in an opening of said second plate.

6. The blade pump as defined in claim 1 wherein said rotation preventing means includes pin and opening interconnection means between said first and second plates, and said pin and opening interconnection means includes a pin projecting from said second plate received in an opening of said first plate.

7. The blade pump as defined in claim 1 wherein said rotation preventing means includes pin and opening interconnection means between said first and second plates, and said pin and opening interconnection means includes a pin projecting into an opening in each of said first and second plates.

8. The blade pump as defined in claim 1 wherein said rotation preventing means includes pin and opening interconnection means between said first and second plates, said pin and opening interconnection means includes an opening in each of said first and second plates, said openings are generally axially aligned, and a pin having portion thereof located in said openings.

9. The blade pump as defined in claim 8 wherein said first plate includes a peripheral edge corresponding generally in outline and size to said stator circular opening.

10. A blade pump comprising a stator having a circular opening, a rotor within said stator circular opening, said rotor carrying a plurality of movable blades for increasing fluid pressure upon rotation of said rotor relative to said stator, said rotor having axially opposite end faces, inlet and outlet means for respectively delivering fluid to and removing pressurized fluid from said rotor, a first plate within said stator circular opening, said first plate having axially opposite end faces, a first of said first plate end faces opposing a first of said rotor end faces and defining therewith at said outlet means a fluid pressure zone subject to the thrust of fluid pressure generated thereat, passage means for directing fluid pressure to a fluid counterbalancing zone at said first plate second face generally axially opposing said fluid pressure zone, a second plate adjacent said first plate second end face, means for rigidly securing said second plate to said stator, means between said first and second plates for preventing rotation of said first plate within said stator circular opening under the rotational forces created by rotation of said rotor relative to said stator, sealing means between said second plate and said first plate second end face for defining said fluid counterbalancing zone in generally peripherally circumscribing relationship to said outlet means whereby fluid pressure developed during rotation of said rotor at said fluid counterbalancing zone counterbalances fluid pressure at said outlet means fluid pressure zone acting against said first plate first surface, and said sealing means further defines a sealing zone radially separating said fluid counterbalancing zone from said inlet means.

11. The blade pump as defined in claim 10 wherein said rotation preventing means is a connection between said first and second plates.

12. The blade pump as defined in claim 10 wherein said rotation preventing means is an axial interconnection between said first and second plates.

13. The blade pump as defined in claim 10 wherein said rotation preventing means includes pin and opening interconnection means between said first and second plates.

14. The blade pump as defined in claim 10 wherein said rotation preventing means includes pin and opening interconnection means between said first and second plates, and said pin and opening interconnection means includes a pin projecting from said first plate received in an opening of said second plate.

15. The blade pump as defined in claim 10 wherein said rotation preventing means includes pin and opening interconnection means between said first and second plates, and said pin and opening interconnection means includes a pin projecting from said second plate received in an opening of said first plate.

16. The blade pump as defined in claim 10 wherein said rotation preventing means includes pin and opening interconnection means between said first and second plates, and said pin and opening interconnection means includes a pin projecting into an opening in each of said first and second plates.

17. The blade pump as defined in claim 10 wherein said rotation preventing means includes pin and opening interconnection means between said first and second plates, said pin and opening interconnection means includes an opening in each of said first and second plates, said openings are generally axially aligned, and a pin having portions thereof located in said openings.

18. The blade pump as defined in claim 17 wherein said first plate includes a peripheral edge corresponding generally in outline and size to said stator circular opening.

19. The blade pump as defined in claim 10 wherein said sealing means is a generally curved sealing element positioned in generally opposed relationship to said inlet means.

20. The blade pump as defined in claim 10 wherein said sealing means is a generally omega-shaped sealing element positoned in generally opposed relationship to said inlet means.

21. The blade pump as defined in claim 10 wherein said passage means includes a passage in said first plate adjacent said inlet means.

22. The blade pump as defined in claim 10 wherein said passage means includes a passage in said second plate adjacent said inlet means.

23. The blade pump as defined in claim 10 wherein said passage means includes a notch in a periphery of said first plate adjacent said inlet means.

24. The blade pump as defined in claim 10 wherein said passage means includes a notch in a periphery of said second plate adjacent said inlet means.

25. The blade pump as defined in claim 10 wherein said passage means includes a passage in said first and second plates adjacent said inlet means.

26. The blade pump as defined in claim 10 wherein said passage means includes a notch in a periphery of said first and second plates adjacent said inlet means.

27. The blade pump as defined in claim 10 wherein said passage means includes at least one throughbore extending completely through said first plate.

28. The blade pump as defined in claim 10 including means for securing said sealing means relative to said first plate first surface.

29. The blade pump as defined in claim 10 including means for securing said sealing means relative to said first plate first face, and said last-mentioned securing means is a groove in said first plate first face receiving said sealing means.

30. The blade pump as defined in claim 10 including means for hinging said stator for swinging movement.

31. The blade pump as defined in claim 10 including third and fourth plates and second sealing means corresponding respectively to said first plate, second plate and first-mentioned sealing means correspondingly disposed at a second of said rotor end faces.

32. The blade pump as defined in claim 21 wherein said passage means further includes at least one through bore through said first plate.

33. The blade pump as defined in claim 22 wherein said passage means further includes at least one through bore through said first plate.

34. The blade pump as defined in claim 23 wherein said passage means further includes at least one through bore through said first plate.

35. The blade pump as defined in claim 24 wherein said passage means further includes at least one through bore through said first plate.

36. The blade pump as defined in claim 25 wherein said passage means further includes at least one through bore through said first plate.

37. The blade pump as defined in claim 26 wherein said passage means further includes at least one through bore through said first plate.

38. A blade pump comprising a stator having a circular opening, a rotor within said stator circular opening, said rotor carrying a plurality of movable blades for increasing fluid pressure upon rotation of said rotor relative to said stator, duct means in said stator for delivering the pressurized fluid to a delivery duct, means for pivotally supporting said stator upon and for pivoting motion relative to said delivery duct, said rotor having axially opposie end faces, inlet and outlet means for respectively delivering fluid to and removing pressurized fluid from said rotor, a first plate within said stator circular opening, said first plate having axially opposite end faces, a first of said first plate end faces opposing a first of said rotor end faces, passage means for directing fluid pressure to a fluid counterbalancing zone at said first plate second face generally axially opposing said fluid pressure zone, a second plate adjacent said first plate second end face, means for rigidly securing said second plate to said stator, and means between said first and second plates for preventing rotation of said first plate within said stator circular opening under the rotational forces created by rotation of said rotor relative to said stator.

39. A blade pump comprising a stator having a circular opening, a rotor within said stator circular opening, said rotor carrying a plurality of movable blades for increasing fluid pressure upon rotation of said rotor relative to said stator, duct means in said stator for delivering the pressurized fluid to a delivery duct, means for pivotally supporting said stator upon and for pivoting motion relative to said delivery duct, said rotor having axially opposite end faces, inlet and outlet means for respectively delivering fluid to and removing pressurized fluid from said rotor, a first plate within said stator circular opening, said first plate having axially opposite end faces, a first of said first plate end faces opposing a first of said rotor end faces and defining therewith at said outlet means a fluid pressure zone subject to the thrust of fluid pressure generated thereat, passage means for directing fluid pressure to a fliud counterbalancing zone at said first plate second face generally axially opposing said fluid pressure zone, a second plate adjacent said first plate second end face, means for rigidly securing said second plate to said stator, means between said first and second plates for preventing rotation of said first plate within said stator circular opening under the rotational forces created by rotation of said rotor relative to said stator, sealing means between said second plate and said first plate second end face for defining said fluid counterbalancing zone in generally peripherally circumscribing relationship to said outlet means whereby fluid pressure developed during rotation of said rotor at said fluid counterbalancing zone counterbalances fluid pressure at said outlet means fluid pressure zone acting against said first plate first surface, and said sealing means further defines a sealing zone radially separating said fluid counterbalancing zone from said inlet means.

* * * * *